US005547239A

United States Patent [19]

Allenbaugh

[11] Patent Number: 5,547,239

[45] Date of Patent: Aug. 20, 1996

[54] LATCH GUARD FOR CENTER HUNG DOORS

[75] Inventor: Howard M. Allenbaugh, Huntington Beach, Calif.

[73] Assignee: M.A.G. Eng. & Mfg. Inc., Huntington Beach, Calif.

[21] Appl. No.: 379,006

[22] Filed: Jan. 27, 1995

Related U.S. Application Data

[63] Continuation of Ser. No. 85,417, Jun. 30, 1993, abandoned.

[51] Int. Cl.[6] ..... E05B 17/00

[52] U.S. Cl. ..... 292/346; 70/416

[58] Field of Search ..... 292/302, 346, 292/357, DIG. 53; 70/416, 418, 452, 417

[56] References Cited

U.S. PATENT DOCUMENTS

| | | | |
|---|---|---|---|
| D. 229,665 | 12/1973 | Wilmot | D8/137 |
| 1,497,842 | 6/1924 | Dollin | 292/348 X |
| 1,579,139 | 3/1926 | Phillips | 292/346 X |
| 2,759,754 | 8/1956 | Kaiser | 292/336.3 X |
| 2,810,600 | 10/1957 | Kendrick | 292/357 |
| 3,290,081 | 12/1966 | Sushan | 292/346 |
| 3,405,962 | 10/1968 | Sushan | 292/346 |
| 3,645,045 | 2/1972 | Gervis et al. | 292/346 X |
| 3,761,119 | 9/1973 | Bennett et al. | 292/346 |
| 4,130,311 | 12/1978 | Sushan | 292/346 |
| 4,484,463 | 11/1984 | Hennessy | 70/452 |
| 4,751,834 | 6/1988 | Beck | 292/346 X |
| 4,861,082 | 8/1989 | Priola et al. | 292/346 |

OTHER PUBLICATIONS

Levine, "DorGard™: designed to protect a door from attack," Locksmith Ledger, Oct. 1990, pp. 86–87, total pages 2.

"Scotsman DorGardIII," pp. 1–2. Total pages 2, date unknown. Sales Literature by Scotsman Security.

"Sentry's Lock Blocker LG–2," pp. 1–2, date: unknown. Packaging by Sentry Door Lock Guards, Inc.

"Latch Protector," p. 1 plus two photographs, date: unknown. Packaging and product by Don–Jo Mfg., Inc.

Latch Guard using Notched Bolt, three photographs, date: unknown.

*Primary Examiner*—Rodney M. Lindsey

*Attorney, Agent, or Firm*—Pretty, Schroeder, Brueggemann & Clark

[57] ABSTRACT

A latch guard for protecting a door latch installed in a door comprises a removable cover plate with a cylinder pivot hole and two mounting holes located generally above and below the cylinder pivot hole. Adjacent to each mounting hole are two slots that extend from the mounting hole. When installed, the cover plate extends over the space between the door and an adjacent door frame in the area of the latch to protect the latch. The cover plate is mounted to the door by first and second mounting bolts that extend through the slots in the cover plate and completely through the door. Each mounting bolt includes a spacer that spaces the enlarged head of the respective mounting bolt so that the cover plate can rotate about the cylinder pivot hole to allow easy installation and removal of the cover plate. The cover plate may also include anti-spread pins. When the door is closed, the anti-spread pins extend into holes in the adjacent door to prevent spreading of the doors and also to prevent rotation of and thus, removal of the latch cover. The cover plate may also have 90° bends at selected locations that provide added structural strength to the cover plate and provide a space to accommodate a strike plate. The cover plate may be permanently installed on door merely by using a slug placed in the respective mounting hole to prevent rotation of the cover plate.

12 Claims, 3 Drawing Sheets

LATCH GUARD FOR CENTER HUNG DOORS

This application is a continuation of application Ser. No. 08/085,417, filed Jun. 30, 1993, now abandoned.

BACKGROUND OF THE INVENTION

The present invention relates generally to protective latch guards for use with locks installed in doors and, more particularly, to a latch guard that protects a lock latch against tampering and that limits separation of the door from an adjacent door or door frame.

A typical door lock prevents unauthorized entry through a door by extending a latch between the door and an adjacent door or door frame. However, this type of lock can be defeated, for example, by inserting a saw or other cutting device into the space between the door and the adjacent door frame and severing the latch where it extends through this space. The latch also can be defeated by inserting a crowbar or the like into the space above the latch and then bending the latch down by pounding on the crowbar with a hammer. One solution to the problems has been to permanently mount a cover plate over the space between the door and the adjacent door frame in the area of the latch.

However, the installation of a permanently installed cover plate can be particularly troublesome with so-called center hung glass doors that typically swing in and out and include a relatively narrow, hollow aluminum frame or stile. In general, the locking mechanism in these doors is installed in the interior of the hollow door stile with a raised cylinder having a key hole accessible through its front wall. Adjacent the glass door is a door frame or another center hung glass door. Since the center hung door generally swings in and out, a permanently installed cover plate would prevent the door from swinging in or prevent an adjacent door from swinging out. Thus, the latch guard should allow the door to swing unrestricted and not interfere with the door's normal operation.

Accordingly, one solution for double swinging glass doors has been to use a retractable shutter plate mounted on the stile of one door that links to another cover housing mounted on the other door. The shutter plate is engaged using a special key just before the door is locked. However, latch guards of the shutter plate type, although somewhat effective, are not entirely satisfactory. For example, installation requires that a number of holes be drilled into the stiles to accommodate the primary and secondary housings and the shutter assembly. Moreover, the shutter plate does not prevent door spreading. Also, shutter plate covers are expensive from a complexity and cost of materials standpoint.

Accordingly, there has existed a definite need for a latch guard adapted for use on inwardly and outwardly swinging narrow stile doors that allows the door to be easily opened and closed without interfering with its normal operation and that prevents tampering with the lock latch and spreading of the door frame. The present invention satisfies these needs and provides further related advantages.

SUMMARY OF THE INVENTION

The present invention provides a removable latch guard for use in protecting a locking mechanism having a raised cylinder installed in a door, such as center hung glass double doors with a relatively narrow, hollow door frame or stile. The latch guard comprises a cover plate and associated mounting hardware. The cover plate is adapted to be removably mounted on an outside surface of a door and sized to extend from the door into an overlapping relation with an adjacent door or door frame.

The cover plate has a cylinder pivot hole located generally to the center of one side of the cover plate and upper and lower mounting holes which are located generally above and below the cylinder pivot hole, respectively, along a line through the center of the cylinder pivot hole. Adjacent to the first and second mounting holes are first and second mounting slots, respectively, having a width and a length. In addition, the length of each slot extends away from the center of the respective mounting hole in a direction substantially perpendicular to a line through the center of the cylinder pivot hole and the respective mounting hole. The length of the first and second slots extend in substantially opposite directions. When the latch guard is installed on the door, the plate extends over the space between the door and the adjacent door in the area of the latch.

The cover plate is mounted on the door in the area of the locking mechanism by a pair of mounting bolts comprising a first mounting bolt and a second mounting bolt. The mounting bolts have an enlarged head, a spacer, and an externally threaded shaft inserted into the mounting holes of the cover plate and through a front wall and a back wall of the door. The enlarged head on each bolt is sized larger than the width of the slots but smaller than the size of the mounting holes. The enlarged head is spaced away from the surface of the door by a spacer to allow the cover plate to slide under the enlarged head and rotate about the cylinder pivot hole with the spacers sliding within the slots such that slot engage the mounting bolts. The enlarged head engages the front surface of the cover plate on the sides of the slots and threaded shaft on the bolt engages a nut at the back wall of the door.

Thus, the cover plate is installed and removed by rotating the cover plate about the cylinder pivot hole. To install latch guard, the cover plate is aligned with the mounting holes over the enlarged head of the bolt. The cover plate is then rotated until the enlarged head is over the slots with the bolts engaged in the slots. To remove the cover plate, it is rotated in the opposite direction until the enlarged head is over the respective mounting hole. In this position, the cover plate can be pulled away from the surface of the door.

In another aspect of the invention, the cover plate further includes an anti-spread feature to prevent the lateral or horizontal spreading of the door with respect to the adjacent door or door frame. In this regard, the cover plate includes anti-spread pins that are located generally on the portion of the cover plate that overlies the adjacent door or door frame. The anti-spread pins are positioned over the adjacent door or door frame when the cover plate is installed. When the door is closed, the anti-spread pins extend into holes in the adjacent door frame. In this way, spreading of the door with respect to the adjacent door or door frame is prevented by the anti-spread pins. In addition, the anti-spread pins prevent rotation of the cover plate about the cylinder pivot hole when the door is closed. Thus, the cover plate cannot be removed until the door is unlocked and the door opened.

In a further aspect of the invention, the cover plate is bent into first and second substantially flat portions and first and second substantially perpendicular sections. The bends, of about 90°, give added structural strength to the cover plate.

In another aspect of the invention, a cylinder guard ring is attached to or formed in the surface of the cover plate. The cylinder guard ring is centered over the cylinder pivot hole and extends away from the door to cover and protect the raised portion of the raised cylinder.

In yet a further aspect of the invention, the cover plate is permanently installed on the door by placing a slug within the mounting holes to prevent rotation of the cover plate about the cylinder pivot hole thereby preventing removal of the cover plate from the door.

Other features and advantages of the present invention will become apparent from the following description of the preferred embodiment, taken in conjunction with the accompanying drawings, which illustrate, by way of example, the principles of the invention.

BRIEF DESCRIPTION OF THE DRAWINGS

The accompanying drawings illustrate the invention. In such drawings.

DESCRIPTION OF THE PREFERRED EMBODIMENT

Figure 1:
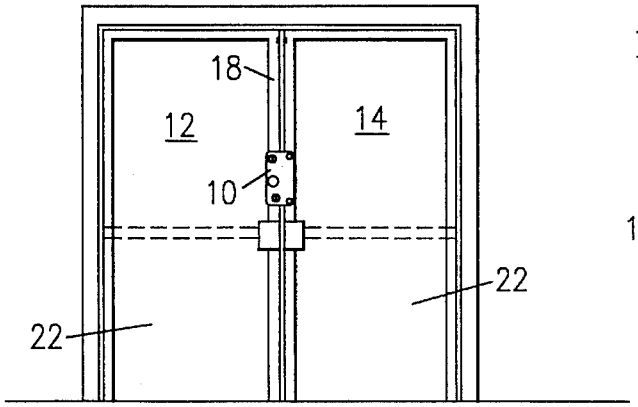
FIG. 1 is an elevational view of a first door and an adjacent door with a latch guard embodying the features of the present invention installed on the first door.

As shown in the exemplary drawings, the present invention is embodied in a removable latch guard, generally referred to by the reference numeral 10, mounted on the outside of a door 12. As shown in FIG. 1, the latch guard 10 extends between the door 12 and an adjacent door 14 to protect a locking mechanism 16 against tampering and to limit spreading of the doors. When the door is not locked, the latch guard may be easily removed so that it does not interfere with normal operation of the door. The latch guard of the present invention is particularly adapted for use on inwardly and outwardly opening center hung doors 12 and 14 having a narrow door stile 18 with a hollow interior space 20 in which the locking mechanism 16 is mounted. The doors 12 and 14 also may have a glass panel 22 or the like installed in the door stiles 18.

Figure 2:
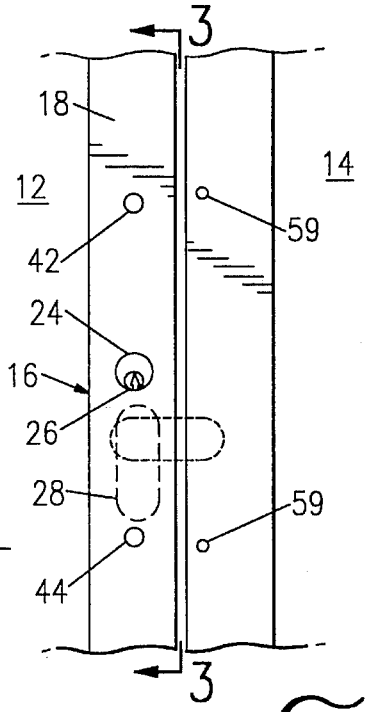
FIG. 2 is an enlarged elevational view of a locking mechanism and its latch installed in a narrow stile door.

FIG. 2 is a more detailed view of the locking mechanism 16 in both locked and unlocked positions. The locking mechanism 16 includes a cylinder 24 having a key hole 26. The cylinder 24 is generally raised from the surface of the door stile 18. The locking mechanism 16 also includes a latch 28, shown in two positions, namely a locked position, in which the latch 28 extends horizontally between the door stile 18 and the adjacent door 14, and an unlocked position, in which the latch 28 extends downwardly into the door stile 18. Generally, the adjacent door 14 is prevented from swinging prior to locking the door 12 by extending a rod (not shown) or the like into a hole in the floor or the door frame above the adjacent door 14 when the adjacent door 14 is closed.

When the locking mechanism 16 of the door 12 is locked, the latch 28 sometimes can be defeated by inserting a crowbar or the like into the space between the doors 12 and 14 above the latch 28 where it extends through this space and then bending the latch 28 down by pounding on the crowbar with a hammer. The latch also may be defeated by inserting a saw or other cutting device into the space between the doors 12 and 14 and cutting the latch 28 where it extends through this space. Accordingly, there is a need for a latch guard that effectively protects the latch 28 when it extends horizontally between the door stile 18 and the stile of the adjacent door 14. The present invention is particularly suited for this purpose.

Figure 3:
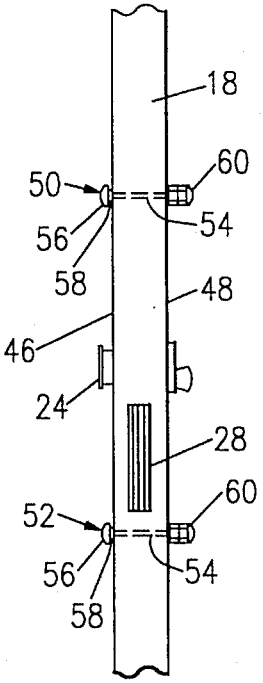
FIG. 3 is an elevational view of the first door taken substantially above the line 3—3 of FIG. 2, showing mounting bolts and a raised cylinder extending from the surface of the door.
Figure 4:
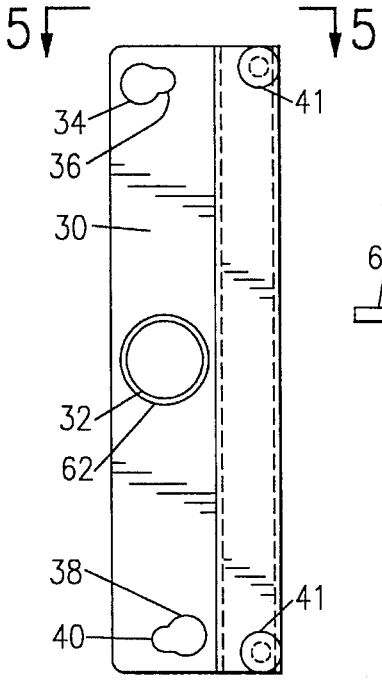
FIG. 4 is an elevational view of the latch guard prior to mounting on the door.
Figure 5:
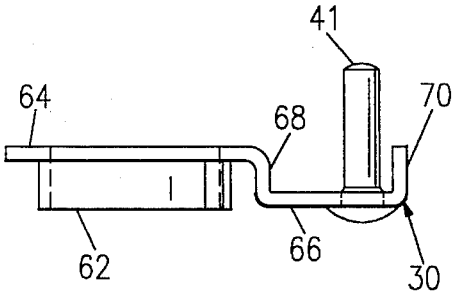
FIG. 5 is a plan view of the latch guard taken substantially along the line 5—5 of FIG. 4.

Referring now to FIGS. 3–5, the latch guard 10 comprises a cover plate 30 having a cylinder pivot hole 32, an upper mounting hole 34 which includes an upper mounting slot 36, a lower mounting hole 38 which includes a lower mounting slot 40, and one or more anti-spread pins 41. The door 12 is prepared to receive the latch guard by having two pairs of holes 42 and 44 drilled in the front wall 46 and the back wall 48 of the door stile at locations corresponding to the mounting holes 34 and 38 in the cover plate 30. Two mounting bolts 50 and 52, each having an externally threaded shaft 54, an enlarged head 56, and a spacer 58, are placed through the holes 42 and 44. The adjacent door 14 has one or more anti-spread holes 59 drilled into the frame or stile of the adjacent door 14. The anti-spread holes 59 are sized and located to receive the anti-spread pins 41. The anti-spread pins prevent spreading of the door 12 with respect to the adjacent door 14.

The mounting holes 34 and 38 in the cover plate 30 have a diameter sufficient to fit over the enlarged head 56 of the mounting bolts 50 and 52. The mounting slots 36 and 40 have a width and a length. The width of the slots 36 and 40 is sufficiently wide to accommodate the spacer 58 of the bolts 50 and 52, but narrow enough such that the enlarged head 56 of the bolts 50 and 52 may not pass through the width of the slots 36 and 40.

The cover plate 30 is sized so that when it is installed, it extends above and below the locking mechanism 16 and over the space between the doors 12 and 14 in the area of the latch 28. The cylinder pivot hole 32 is positioned such that it will expose the front face of the cylinder 24 and allow access to the key hole 26 when the latch guard 10 is installed. The mounting holes 34 and 38 are generally located in a symmetric fashion above and below the cylinder pivot hole 32 at a distance far enough so that the corresponding mounting bolts 50 and 52 in the door stile 18 do not interfere with the movement of the latch 28. The mounting slots 36 and 40 are oriented such that the length of the slots 36 and 40 are perpendicular to a line through the center of the cylinder pivot hole 32 and the centers of the mounting holes 34 and 38. The anti-spread pins 41 are located generally on the corners of the cover plate 30 such that the pins 41 engage the anti-spread holes 59 in the stile of the adjacent door 14 when the doors are closed.

In the preferred embodiment, the mounting bolts 50 and 52 are carriage bolts having a threaded shaft 54 of sufficient length that it extends through the cover plate 30 and completely through the front and back walls 46 and 48 of the door stile 18 to engage an internally threaded nut 60 tightened over the end of the shaft 54 from the back of the door stile 18. Each carriage bolt has a smooth enlarged head 56 which is sized to fit through the mounting holes 34 and 38 in the cover plate 30. However, the enlarged head 56 is larger than the width of the mounting slots 36 and 40. Each carriage bolt has a small shoulder (not shown) between the enlarged head 56 and the shaft 54. The shoulder acts as the spacer 58 and allows the cover plate 30 to slide under the enlarged head 56 of the mounting bolts 50 and 52.

In a more detailed feature of the invention, the cylinder pivot hole 32 has a cylinder guard ring 62 that fits around the raised portion of the cylinder 24. The cylinder guard ring 62 protects the cylinder 24 from tampering from pliers, channel locks, and the like.

In another more detailed feature of the invention, the cover plate 30 has two substantially flat portions 64 and 66 and two substantially perpendicular sections 68 and 70 for added structural strength and to accommodate a wide variation of adjacent door or frame sizes. In addition, this feature creates a space between the cover plate 30 and the gap between the doors 12 and 14 allowing the cover plate 30 to accommodate a locking mechanism that incorporates a spring-loaded latch and a strike plate (not shown) on the adjacent door 14. Typically, the strike plate extends a small distance from the surface of the door 14 in which case the cover plate 30 is provided with a raised flat portion 66 to accommodate the strike plate.

The mounting holes 34 and 38 and the cylinder pivot hole 32 are located on the first flat portion 64. The anti-spread pins 41 are located on the raised second flat portion 66 that overlies the stile of the adjacent door 14. The first perpendicular section 68 connects to the first and second flat portions 64 and 66 in a perpendicular fashion as shown in FIG. 5. The second perpendicular section 70 is attached to the second flat portion 64 along an edge opposite the edge attached to the first perpendicular section 68. The surfaces of the second flat portion and the second perpendicular section are generally perpendicular with each other. The surfaces of the first and second perpendicular sections 68 and 70 are generally parallel with each other. The second perpendicular section 70 strengthens and inhibits the placement of prying tools under the second flat portion 64. In the preferred embodiment, the entire cover plate 30 is formed of a single piece of heavy sheet metal and formed by bending the sheet metal at the appropriate locations.

Figure 6:
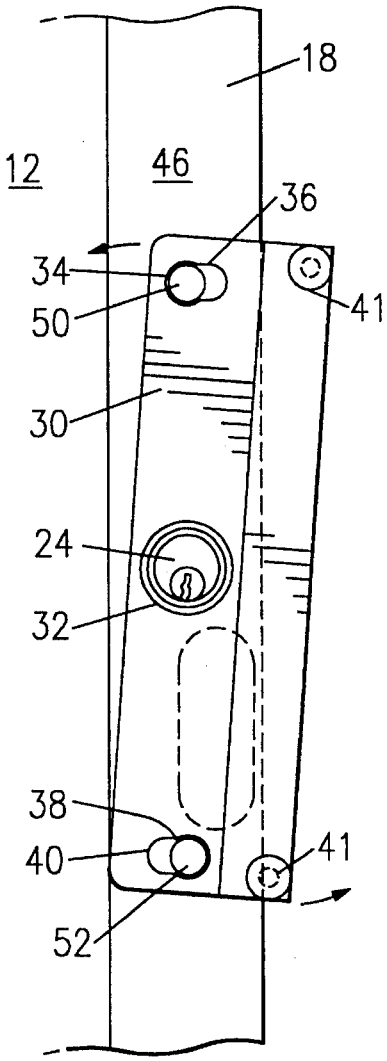
FIG. 6 is an elevational view of a mounted latch guard being mounted on an open door before rotation of the cover plate.
Figure 7:
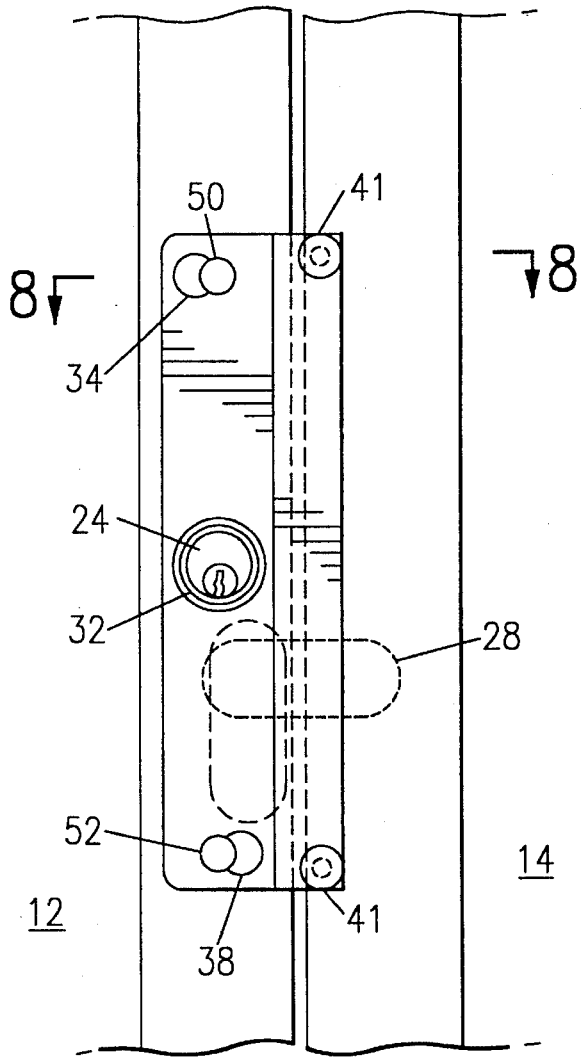
FIG. 7 is an elevational view of a mounted latch guard mounted on a closed door.
Figure 8:
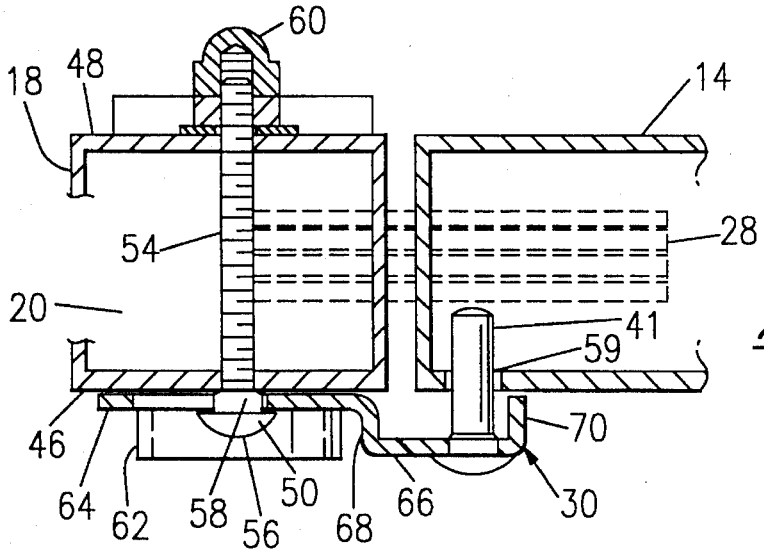
FIG. 8 is a cross-sectional plan view of the mounted latch guard taken substantially along the line of 8—8 of FIG. 7, showing the penetration of an anti-spread pin into a hole in an adjacent door or door frame.

To mount the latch guard 10 of the present invention, the first door 12 is held in an open position and the cover plate 30 is placed against the front wall 46 of the door stile 18 with the door's cylinder 24 positioned through the cylinder pivot hole 32 and with the mounting bolts 50 and 52 positioned through the mounting holes 34 and 38 as shown in FIG. 6. Note that the length of each mounting slot 36 and 40 is generally proportional to the distance between the center of the cylinder pivot hole and the center of the mounting hole associated with the respective mounting slot. Next, the cover plate 30 is rotated until the mounting bolts 50 and 52 are engaged in the mounting slots 36 and 40 and the cover plate 30 is in a substantially vertical position as shown in FIG. 7. Then the door 12 is closed and the door latch 28 moved to the locked position as shown in FIG. 8. The anti-spread pins 41 penetrate holes 59 in the stile of the adjacent door 14 to prevent the cover plate 30 from rotating. Thus, the cover plate 30 cannot be removed until the door 12 is opened. The cover plate 30 can be removed when the door 12 is unlocked and opened. When the cover plate 30 is removed, it is stored in a convenient location or it is mounted on the door 12 with the overlying portion of the cover plate 30 facing inwardly over the glass panel 22. To remove the cover plate 30, it is rotated in a direction opposite the installation rotation direction until the enlarged head 56 of each mounting bolt 50 and 52 is over the respective mounting hole 34 and 38. In this position, the cover plate 30 can be pulled away from the front wall 46 of the door 12.

Figure 11:
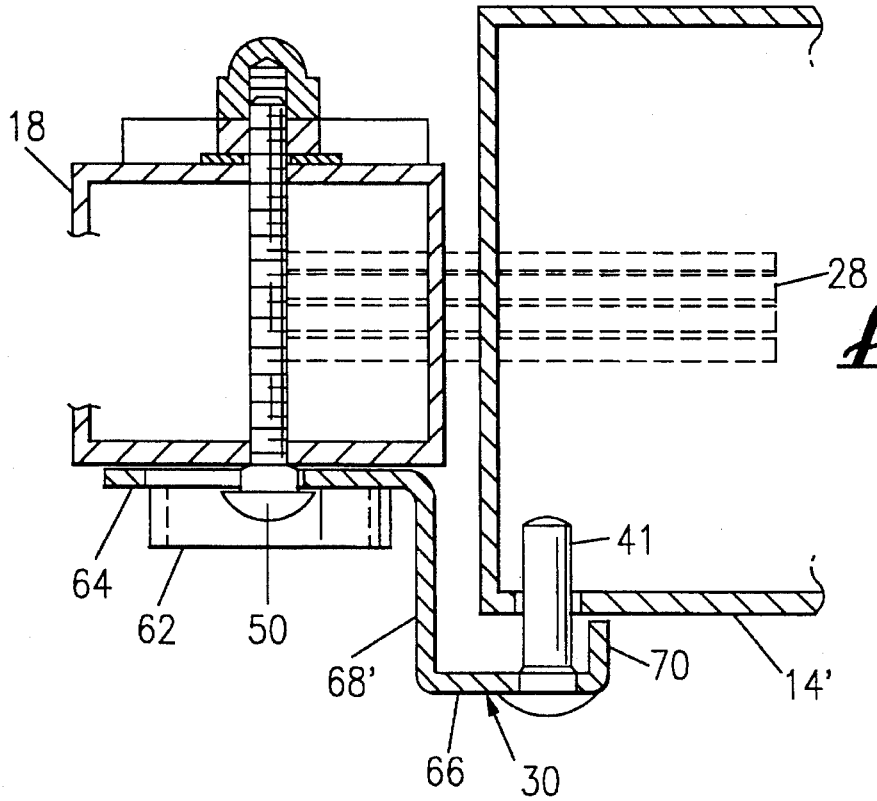
FIG. 11 is a cross-sectional plan view of a mounted latch guard having an extended perpendicular section sized to fit an adjacent door frame that extends beyond the surface of the door.

In the embodiment discussed above, the door 12 is described as being one door forming a double door combination with a second adjacent door 14, both of which swing inwardly and outwardly. However, the door 12 may also be a single door adjacent a door frame 14', as shown in FIG. 11. If the width of the adjacent door frame 14' is wider than that of the door stile 18 described above, the width of the first perpendicular section 68 of the cover plate 30 is lengthened to accommodate the wider door frame 14'. For the center hung door that is inwardly and outwardly opening, the installation of the removable cover plate 30 is similar as that described above.

Figure 9:
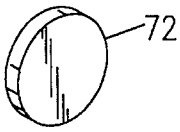
FIG. 9 is a perspective view of a slug.
Figure 10:
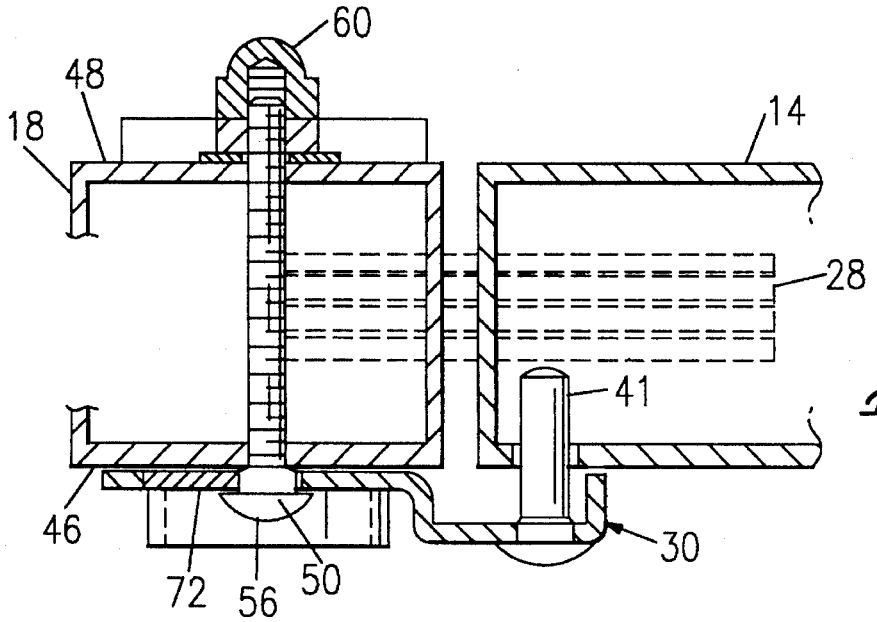
FIG. 10 is a cross-sectional plan view of the mounted latch guard showing the slug installed to permanently attach the latch guard to an outwardly opening door.

In a further embodiment, the latch guard 10 of the present invention may be permanently installed on an outwardly opening only single or double door 12. Permanent installation of the latch guard 10 uses a slug 72 placed in the mounting holes 34 and 38 as shown in FIG. 10. Permanent installation of the cover plate 30 differs slightly from the removable installation as discussed above in that the cover plate 30 is placed against the front wall 46 of the door stile 18 prior to installation of the mounting bolts 50 and 52. The cover plate 30 is placed such that the raised cylinder 24 is in the cylinder pivot hole 32 and the mounting slots 36 and 40 are aligned with the first and second holes 42 and 44 in the door stile 18. The slug 72, shown in FIG. 9, is then placed in each mounting hole 34 and 38. The slug 72 is sized to fit snugly within the mounting holes 34 and 38. The mounting bolts 50 and 52 are then placed through the slots 36 and 40 and then through the first and second holes 42 and 44. A nut 60 is then tightened over the end of each mounting bolt 50 and 52 from the back of the door stile 18. The enlarged head 56 of each bolt 50 and 52 overlaps each slug 72 and prevents the slug's removal from the corresponding mounting holes 34 and 38. Thus, the latch guard 10 can be permanently installed merely by using the slug 72 shown in FIG. 9 without modification of the cover plate 30, hole locations or associated mounting hardware.

In this way, a single latch guard 10 can be used in a variety of different configurations. In addition, an inwardly and outwardly opening center hung door can be permanently converted to an outwardly opening only door with the permanent installation of the latch guard shown in FIG. 10. As a result of the versatility of the latch guard 10, fewer variations of latch covers 30 need to be manufactured and maintained in inventory for most applications.

It will be appreciated from the foregoing description that the present invention provides an improved latch guard 10 that effectively protects the door latch 28 where it extends horizontally between the door 12 and the adjacent door frame 14. The combination of specially configured mounting bolts, slotted mounting holes, and a cylinder pivot hole provides a removable latch guard that can be securely fastened and held over the latch when the door is closed and the latch is in the locked position.

Although the present invention has been described in detail with reference to the presently preferred embodiment, it will be appreciated by those of ordinary skill in the art that various modifications can be made without departing from the spirit and scope of the invention. For example, the invention may also be used with hollow doors without a door stile. Moreover, the adjacent door frame may also be the frame of a second door, as is common when double doors are used. Accordingly, the invention is limited only by the following claims.

I claim:

1. A latch guard for protecting a door latch of a door having a raised cylinder, the latch guard comprising:

a cover plate adapted to be removably mounted on a surface of a door and sized to extend from the door into overlapping relation with an adjacent door or door frame, the cover plate having, a cylinder pivot hole sized to allow the raised cylinder to pass therethrough, first and second mounting holes located at substantially equal distances from the cylinder pivot hole, the first mounting hole located above the cylinder pivot hole and the second mounting hole located below the cylinder pivot hole, first and second slots formed in the first and second mounting holes, respectively, each slot having a width and a length, each slot extending away from a center of the respective mounting hole in a direction substantially perpendicular to a line through the center of the cylinder pivot hole and the center of the respective mounting hole, and the slot of the second mounting hole extending in a direction substantially opposite the direction of the first slot;

first and second substantially flat portions, the first substantially flat portion having the cylinder pivot hole, the first and second mounting holes and the first and second slots, wherein the first flat portion is adapted to be mounted on the door surface with the second flat portion extending from the door into overlapping relation with the adjacent door or door frame, and first and second substantially perpendicular sections, the first perpendicular section connecting the first and second flat portions, and the second perpendicular section being connected to the second flat portion along an edge opposite the first perpendicular section, wherein the first and second perpendicular sections increase the strength of the cover plate; and first and second mounting bolts, each mounting bolt having an enlarged head, a spacer, and a shaft, the enlarged head sized to be larger than the width of the first and second slots but smaller than the size of the respective first and second mounting holes and the spacer being sized to fit within the width of the slot, the mounting bolts further being adapted to be mounted in the door with the shaft extending into holes in the surface of the door at locations corresponding to the location of the first and second mounting holes, such that the enlarged head of each bolt is spaced away from the surface of the door by the spacer to allow the cover plate to slide under the enlarged head, and such that the cover plate may rotate about the cylinder pivot hole with the spacers adapted to slide within the respective first and second slots to allow the cover plate to be retained by the enlarged head of the respective mounting bolts.

2. The latch guard of claim 1, further comprising one or more anti-spread pins connected to the cover plate on a portion of the cover plate that overlies the adjacent door or door frame when the cover plate is installed and the door is closed, wherein the anti-spread pins are adapted to engage holes located in the adjacent door or door frame to prevent rotation of the cover plate about the cylinder pivot hole when the door is closed.

3. The latch guard of claim 1, further comprising:

a cylinder guard ring connected on a surface of the cover plate facing away from the door, the cylinder guard ring centered over the cylinder pivot hole and adapted to cover and protect the raised portion of the cylinder.

4. The latch guard of claim 1, wherein the first and second mounting bolts are mounted in the door along a vertical line through the center of the raised cylinder.

5. The latch guard of claim 1, further comprising an internally threaded nut that can be tightened over the end of each bolt's shaft remote from the head of the bolt at a back wall of the door, and wherein the shaft of each of the first and second bolts is externally threaded and sized to extend through the cover plate and through a front and the back wall of the door to receive the nut.

6. A latch guard for protecting a door latch of a door having a raised cylinder, the latch guard comprising:

a cover plate adapted to be removably mounted on a surface of a door and sized to extend from the door into overlapping relation with an adjacent door or door frame, the cover plate having, a cylinder pivot hole sized to allow the raised cylinder to pass therethrough, first and second mounting holes located at substantially equal distances from the cylinder pivot hole, the first mounting hole located above the cylinder pivot hole and the second mounting hole located below the cylinder pivot hole, first and second slots formed in the first and second mounting holes, respectively, each slot having a width and a length, each slot extending away from a center of the respective mounting hole in a direction substantially perpendicular to a line through the center of the cylinder pivot hole and the center of the respective mounting hole, and the slot of the second mounting hole extending in a direction substantially opposite the direction of the first slot;

first and second mounting bolts, each mounting bolt having an enlarged head, a spacer, and a shaft, the enlarged head sized to be larger than the width of the first and second slots but smaller than the size of the respective first and second mounting holes and the spacer being sized to fit within the width of the slot, the mounting bolts further being adapted to be mounted in the door with the shaft extending into holes in the surface of the door at locations corresponding to the location of the first and second mounting holes, such that the enlarged head of each bolt is spaced away from the surface of the door by the spacer to allow the cover plate to slide under the enlarged head, and such that the cover plate may rotate about the cylinder pivot hole with the spacers adapted to slide within the respective first and second slots to allow the cover plate to be retained by the enlarged head of the respective mounting bolts; and one or more slugs sized to fit within the first and second mounting holes to prevent rotation of the cover plate about the cylinder pivot hole thereby preventing removal of the cover plate from the door.

7. A latch guard for protecting a door latch of a door having a raised cylinder, the latch guard comprising:

a cover plate adapted to be removably mounted on a surface of a door and sized to extend from the door into overlapping relation with an adjacent door or door frame, the cover plate having, a cylinder pivot hole sized to allow the raised cylinder to pass therethrough, first and second mounting holes located at substantially equal distances from the cylinder pivot hole, a center of the mounting holes being located along a line through a center of the cylinder pivot hole, first and second slots formed in the first and second mounting holes, respectively, each slot having a width and a length, each slot extending away from the center of the respective mounting hole in a direction substantially perpendicular to a line through the center of the cylinder pivot hole and the center of the respective mounting hole, and the slot of the second mounting hole extending in a direction substantially opposite the direction of the first slot, first and second substantially flat portions, the first flat portion having the cylinder pivot hole and the first and second mounting holes and adjacent slots and is adapted to be mounted on the door surface, and the second flat portion sized to extend from the door into overlapping relation with the adjacent door or door frame, first and second substantially perpendicular sections, the first perpendicular section connecting the first and second flat portions, and the second perpendicular section being connected to the second flat portion along an edge opposite the first perpendicular section, wherein the first and second perpendicular sections increase the strength of the cover plate;

first and second mounting bolts, each mounting bolt having an enlarged head, a spacer, and a shaft, the enlarged head sized to be larger than the width of the first and second slots but smaller than the size of the respective first and second mounting holes, and the spacer being sized to fit within the width of the slot, the mounting bolts further being adapted to be mounted in the door with the shaft extending into holes in the surface of the door at locations along a vertical line through the center of the cylinder, such that the enlarged head of each bolt is spaced away from the surface of the door by the spacer to allow the cover plate to slide under the enlarged head, and such that the cover plate may rotate about the cylinder pivot hole;

a cylinder guard ring connected on a surface of the cover plate facing away from the door, the cylinder guard ring centered over the cylinder pivot hole and adapted to cover the raised portion of the cylinder;

an anti-spread pin connected to the cover plate on a portion of the cover plate that overlies the adjacent door or door frame when the cover plate is installed and the door is closed; and wherein the anti-spread pin is adapted to engage a hole located in the adjacent door or door frame to prevent rotation of the cover plate about the cylinder pivot hole when the door is closed.

8. The latch guard of claim 7, further comprising one or more slugs sized to fit within the first and second mounting holes to prevent rotation of the cover plate about the cylinder pivot hole.

9. The latch guard of claim 7, wherein the distance that the first perpendicular section separates the first and second flat portions is greater than the distance the second perpendicular section extends from the second flat portion allowing the latch guard to accommodate an adjacent door frame that extends beyond the surface of the door.

10. A latch guard for protecting a door latch of a door having a raised cylinder, the latch guard comprising:

a cover plate adapted to be removably mounted on a surface of a door and sized to extend from the door into overlapping relation with an adjacent door or door frame, the cover plate having, a cylinder pivot hole sized to allow the raised cylinder to pass therethrough, first and second mounting holes, the first mounting hole generally located above the cylinder pivot hole and the second mounting hole generally located below the cylinder pivot hole, first and second slots formed in the first and second mounting holes, respectively, each slot having a width and a length, each slot extending away from a center of the respective mounting hole in a direction substantially perpendicular to a line through a center of the cylinder pivot hole and through a center of the respective mounting hole, and the slot of the second mounting hole extending in a direction substantially opposite the direction of the first slot;

first and second substantially flat portions, the first substantially flat portion having the cylinder pivot hole, the first and second mounting holes and the first and second slots, wherein the first flat portion is adapted to be mounted on the door surface with the second flat portion extending from the door into overlapping relation with the adjacent door or door frame, and first and second substantially perpendicular sections, the first perpendicular section connecting the first and second flat portions, and the second perpendicular section being connected to the second flat portion along an edge opposite the first perpendicular section, wherein the first and second perpendicular sections increase the strength of the cover plate; and first and second enlarged heads spaced away from the door's surface by first and second shafts, respectively, that extend from the door in a direction perpendicular to the door's surface, wherein the first and second shafts are adapted to be attached to the door at locations corresponding to the first and second mounting holes, respectively, each enlarged head is sized to be smaller than the size of the respective mounting hole but larger than the width of the respective slot and each shaft is sized to fit within the width of the respective slot, the first and second shafts space the respective enlarged heads a distance away from the surface of the door sufficient to allow the cover plate to slide under the enlarged heads, so that the cover plate may rotate about the cylinder pivot hole until the shafts are within the respective first and second slots to allow the cover plate to be retained by the enlarged heads.

11. The latch guard of claim 10, further comprising one or more anti-spread pins connected to the cover plate on a portion of the cover plate that overlies the adjacent door or door frame when the cover plate is installed and the door is closed, wherein the anti-spread pins are adapted to engage holes located in the adjacent door or door frame to prevent rotation of the cover plate about the cylinder pivot hole when the door is closed.

12. The latch guard of claim 10, further comprising:

a cylinder guard ring connected on a surface of the cover plate facing away from the door, the cylinder guard ring centered over the cylinder pivot hole and adapted to cover and protect the raised portion of the cylinder.

* * * * *